United States Patent [19]

Folland

[11] Patent Number: 5,064,073

[45] Date of Patent: Nov. 12, 1991

[54] ONE PIECE CAPSULE WITH OPTIONAL INSERT AND TAPE SEAL

[75] Inventor: Jeffrey A. Folland, 4103 Monroe St., Minneapolis, Minn. 55421

[73] Assignee: Jeffrey Alan Folland, Minneapolis, Minn.

[21] Appl. No.: 557,198

[22] Filed: Jul. 24, 1990

[51] Int. Cl.[5] ..... B43M 7/00; B65D 1/04; B65D 41/00

[52] U.S. Cl. ..... 220/359; 215/227; 215/232; 215/6; 206/822; 229/123.1

[58] Field of Search ..... 206/633, 822, 601; 220/359; 215/227, 232, 6

[56] References Cited

U.S. PATENT DOCUMENTS

| | | | |
|---|---|---|---|
| 464,121 | 12/1891 | Heineman | 206/822 X |
| 1,651,023 | 11/1927 | Hanna | 215/227 |
| 1,715,757 | 6/1929 | Hirtzler | 206/822 X |
| 2,766,796 | 10/1956 | Tupper | 215/6 X |
| 3,367,484 | 2/1968 | Nelson | 206/538 X |
| 3,561,668 | 2/1971 | Bergstrom | 215/227 X |
| 4,266,698 | 5/1981 | Rausing | 206/633 X |

FOREIGN PATENT DOCUMENTS

| | | | |
|---|---|---|---|
| 1491050 | 6/1967 | France | 206/822 |

*Primary Examiner*—William I. Price

[57] ABSTRACT

A one piece, spherical capsule with a hole through which products can be inserted and removed. The hole could accommodate an insert containing a separate product for vending two products in one container. Products will be sealed inside by a single tape seal with a pull tab. The capsule is designed to be dispensed in a bulk vending machine. Bulk vending machines usually dispense prizes or toys packaged in two piece capsules.

1 Claim, 2 Drawing Sheets

ONE PIECE CAPSULE WITH OPTIONAL INSERT AND TAPE SEAL

BACKGROUND

1. Field of the Invention

This invention relates to a new packaging, specifically to an improved capsule to be dispensed from a bulk vending machine. A bulk vending machine is a gumball-type machine which usually dispenses capsules containing toys or prizes for children. Existing capsules work well for their intended purpose. The purpose of the new capsule is to package and dispense laundry detergent and related products through bulk vending machines.

2. Description of Prior Art

Existing two piece capsules when filled with laundry detergent may separate during operation. Two piece capsules are difficult to open and are messy to use. These capsules are not easily filled and closed. Commonly used two inch capsules are too small to contain enough laundry detergent, or to hold two laundry products, such as soap and a dryer sheet.

OBJECTS AND ADVANTAGES

Accordingly, several objects and advantages of my invention are to provide a capsule with one piece construction which does not separate during operation, to provide a capsule with a hole that will accommodate a plastic cup insert containing a separate product for vending two products in one container, such as laundry detergent and dryer sheets, to provide a capsule with a spherical shape that reduces friction during operation, to provide a capsule which is easy to open by peeling back a tape seal for easy access to the product, to provide a capsule which is less messy to use because it is easier to open, to provide a capsule which has a tape seal protecting the quality of the product, to provide a capsule which can be filled easier and faster, to provide a capsule large enough to hold an adequate measured amount of laundry detergent, to provide low cost packaging of laundry products, to provide a capsule which can be machine filled for mass distribution, to provide a capsule which can be used in existing bulk vending machines which are inexpensive, reliable, small, easy to install, and have a large capacity.

Readers will find further objects and advantages of the invention from a consideration of the ensuing description and the accompanying drawings. cl DRAWING FIGURES FIG. 1 shows the side view of the one piece capsule only.

DRAWING REFERENCE NUMERALS

10 one piece capsule
12 access hole of capsule
14 coffee-creamer type cup
16 lip of 14
18 circular tape seal
20 easy-peel tab of 18

DESCRIPTION OF INVENITON

Figure 1:
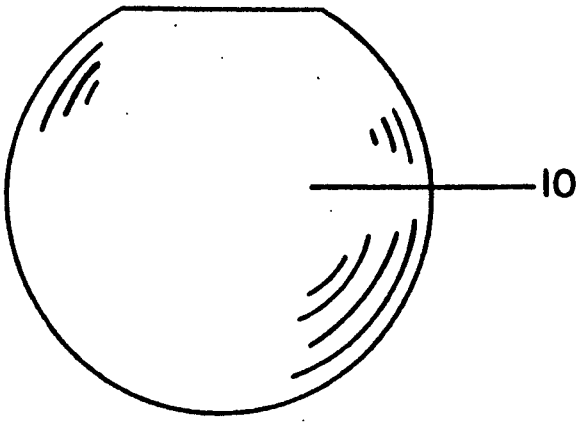

FIG. 1 is a side view of only the one piece, spherical, plastic capsule 10.

Figure 2:
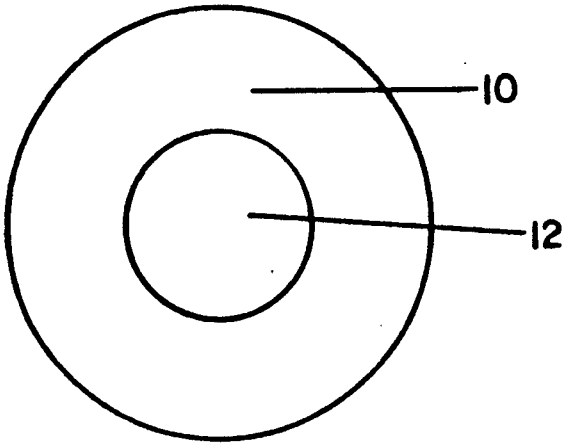
FIG. 2 shows the top view and hole of one piece capsule only.

FIG. 2 is the top view of the capsule showing the access hole 12.

Figure 3:
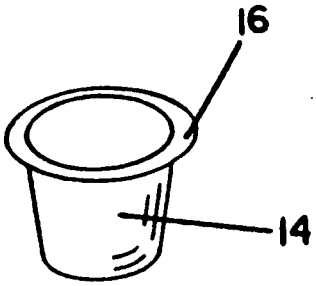
FIG. 3 shows elevational view of the coffee-creamer type cup insert.

FIG. 3 is a coffee-creamer type cup 14 made of plastic with a lip 16 which rests on the rim of the access hole 12 preventing the cup 14 from passing through the hole 12 completely.

Figure 4:
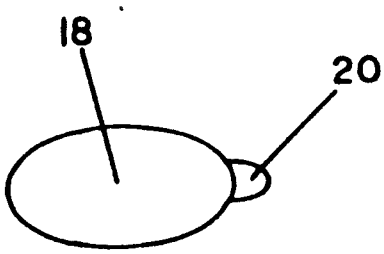
FIG. 4 shows circular tape seal that fits over the hole of the capsule with easy-peel tab.

FIG. 4 is a tape seal 18 with sufficient strength and size to seal hole 12 containing cup 14. A non-stick pull tab 20 extending from tape seal 18 is included for easy removal of the tape seal 18.

Figure 5:
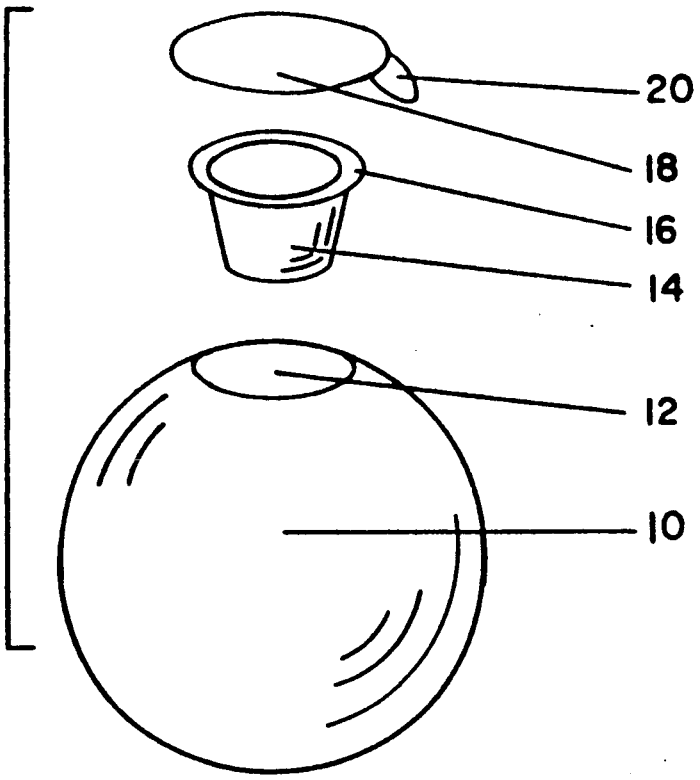
FIG. 5 shows an elevational view of all the components of the invention in relation to each other.

FIG. 5 shows the order of assembly of all the components, the plastic spherical capsule 10, with the access hole 12, into which coffee-creamer type cup 14 is placed with lip 16, which will rest on the rim of hole 12. The tape seal 18 will pull tab 20 will seal both cup 14 and capsule 10.

Figure 6:
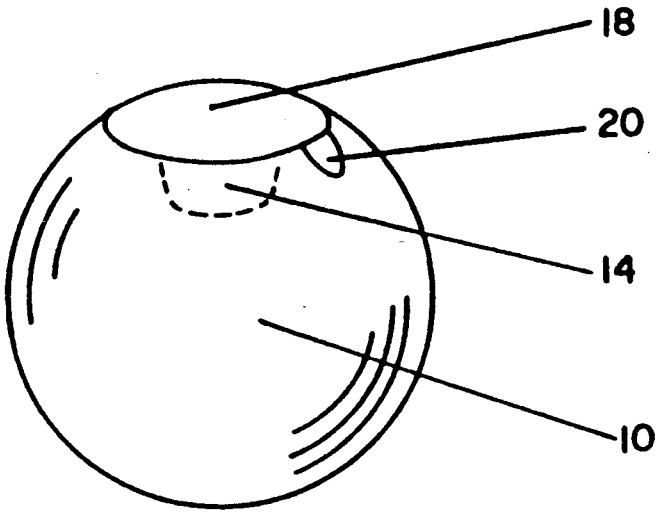
FIG. 6 shows elevational view of the capsule and cup insert sealed by tape seal.

FIG. 6 shows assembled capsule 10, with inserted cup 14, and tape seal 18.

OPERATION OF INVENTION

The invention is a capsule with two compartments for vending two products simultaneously as efficiently as possible. The spherical shape reduces friction for easy operation in a bulk vending machine. The cup can contain one product and be easily inserted into the capsule which has been partially filled with another product. For example, the capsule could contain a measured amount of laundry soap and the cup insert could contain a dryer sheet. The cup could be inserted into the capsule and both could be sealed with an easy-to-remove tape seal with a pull tab. This would be a means for providing laundry detergent in dormitories, apartment complexes, trailer parks and motels. This new packaging invention will utilize a reliable, inexpensive machine which is small, easy to install and has a large capacity. Bulk vending machines are already in use and available from many manufacturers.

CONCLUSIONS, RAMIFICATIONS, AND SCOPE OF INVENTION

Thus the reader will see that the One Piece Capsule with Optional Insert and Tape Seal provides a necessary product for the consumer, expands the market for the manufacturers of laundry products, vending machines, and capsules, and is profitable to vendors.

While the above description contains a specific example, this does not limit the scope of the invention. Many other variations are possible. The capsule can be manufactured in various sizes and the insert can be formed to accommodate different shaped products. These products could include suntan oil and towelette, or such things as aspirin and mineral water. The capsule could also be used without the insert for more efficient vending of candy and nuts. Accordingly, the scope of the invention should not be limited by the examples given. The examples should demonstrate the capsule's versatility.

I claim:

1. A capsule for dispensing products from a bulk vending machine comprising:

a spherical shape as a means for reducing friction and resistance during operation of said vending machine, one piece construction as a means to eliminate separation during operation, and facilitate the filling of said capsule by mechanical means, a single hole as a means to provide access to contained products, and provide a rim on which to rest an optional insert as a means to contain and isolate a second product within said spherical container, thereby vending two products simultaneously, a tape seal as a means to simultaneously seal said spherical container and said optional insert.

* * * * *